United States Patent [19]

Wyborn

[11] Patent Number: 4,615,125

[45] Date of Patent: Oct. 7, 1986

[54] CLOTHES DRYER

[76] Inventor: Kenneth G. Wyborn, South Grafton, Australia

[21] Appl. No.: 655,421

[22] Filed: Sep. 28, 1984

[30] Foreign Application Priority Data

Sep. 30, 1983 [AU] Australia ..... PG1644

[51] Int. Cl.[4] ..... F26B 11/04

[52] U.S. Cl. ..... 34/92; 34/133

[58] Field of Search ..... 34/92, 133, 242, 15

[56] References Cited

U.S. PATENT DOCUMENTS 2,555,821 6/1951 Smith ..... 34/92
2,574,298 11/1951 Smith ..... 34/92
2,643,463 6/1953 Grantham ..... 34/133
3,238,750 3/1966 Candor et al. ..... 34/92
4,305,211 12/1981 Peterson ..... 34/92

*Primary Examiner*—Albert J. Makay
*Assistant Examiner*—David W. Westphal
*Attorney, Agent, or Firm*—Schwartz, Jeffery, Schwaab, Mack, Blumenthal & Evans

[57] ABSTRACT

A clothes dryer has, within a cabinet, a vacuum chamber in which a perforated drum is rotatable, a loading doorway in the cabinet, through which clothes to be dried can be fed into the drum, being provided with a door which, when closed, seals the vacuum chamber. A motor rotates the drum and a vacuum pump withdraws air and water vapor from the vacuum chamber and the contained drum, electric heating elements in the chamber heating the drum and its contents.

3 Claims, 2 Drawing Figures

CLOTHES DRYER

BACKGROUND OF THE INVENTION (1) Field of the Invention

This invention relates to a clothes dryer.

(2) Prior Art

A domestic clothes dryer of well-known type consits normally of a cabinet containing a rotary perforated cylindrical drum, its axis horizontal, and with a number of inwardly extending vanes, clothes to be dried being fed into the drum through a hinged door in the cabinet, the drum then being heated electrically, as it is rotated by a motor, for the extraction of moisture.

Cothes dryers of this type are generally effective, but have fairly high running costs.

SUMMARY OF THE PRESENT INVENTION

The present invention has been devised with the general object of providing a clothes dryer which, though simple and economical to manufacture, is also quick and inexpensive in operation.

The invention resides broadly in a clothes dryer of the type including a chamber, a perforated rotary drum within the chamber, a loading doorway in the chamber through which clothes may be loaded into the drum, a door for closing the doorway, drive means for rotating the drum and heating means for heating its contents, wherein sealing means are provided for making an airtight seal between the closed door and the loading doorway, and evacuating means are provided for creating a partial vacuum within the chamber and the drum therein to vaporize moisture in the clothes and withdraw air and water vapour. Preferably there is provided a valve-controlled air inlet to the chamber, for breaking the partial vacuum therein and permitting the door to be opened at the conclusion of the drying. Other features of the invention will become apparent from the following description.

BRIEF DESCRIPTION OF THE DRAWINGS

A preferred embodiment of the invention is shown in the accompanying drawings, wherein.

DETAILED DESCRIPTION OF THE PREFERRED EMBODIMENT

Figure 2:
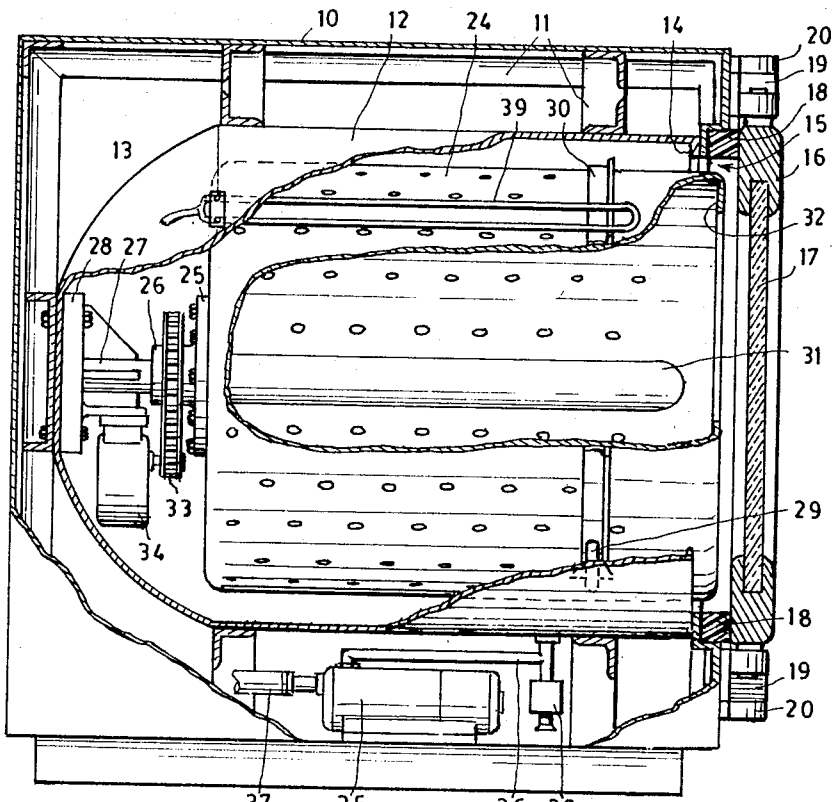
FIG. 2 is a partly broken-away side elevational view of the clothes dryer.
Figure 1:
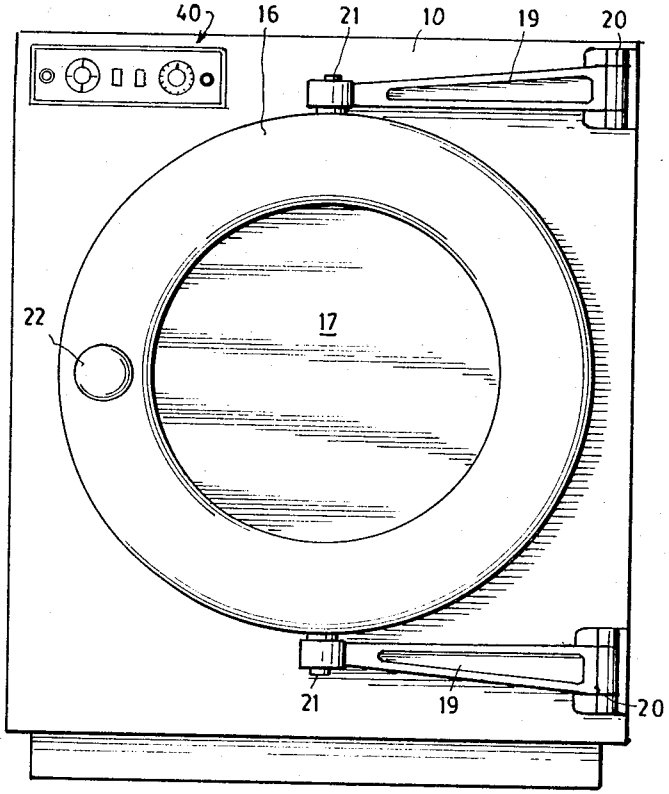
FIG. 1 is a front elevational view of a clothes dryer according to the invention.

The clothes dryer illustrated includes a cabinet 10 of sheet metal fixed upon a rigid main frame 11.

A vacuum chamber 12 is rigidly mounted within the main frame 11, and is substantially cylindrical, its axis horizontal, with a domed rear end 13. The front end of the vacuum chamber has an inturned peripheral flange 14 which is secured and sealed to the periphery of a loading opening 15 in the front of the cabinet 10. The loading opening may be closed by a circular door 16 with a strong transparent window 17 and a resiliently compressible sealing gasket 18 secured about its rear face. The door 16 is mounted betweeen a pair of arms 19 hinged at 20 to one side of the front of the cabinet 10 and engaging trunnions 21 at the top and bottom of the door in such manner that the door is allowed limited pivotal movement to ensure that when the door is closed its sealing gasket 18 will be completely seated about the loading opening 15. The door may be opened by a handle 22.

A cylindrical perforated drum 24 is rotatably mounted coaxially within the vacuum chamber 12, its closed rear end being bolted to a circular flange 25 on the front end of a hub 26 rotatably mounted, with suitable antifriction bearings (not shown) on a shaft 27 rigidly secured to and extending forwardly of a mounting plate 28 fixed to the middle part of the domed rear end 13 of the vacuum chamber 12. The front part of the drum is supported by a pair of rollers 29 rotatably mounted in the lower part of the vacuum chamber 12 and engaging a circumferential rail 30 about the drum. The drum 24 has a number of inwardly extending tumbler vanes 31, and at its front is an inturned peripheral retaining flange 32.

The drum 34 may be rotated by a chain drive at 33 from an electric motor and gearbox assembly 34 mounted within the rear of the vacuum chamber 12.

The vacuum chamber 12 and contained drum 24 may be evacuated, when the door 16 is closed, by an electrically driven vacuum pump 35. An air line 36 leads from the vacuum chamber to the intake of the vacuum pump, the exhaust of which is connected to a waste pipe 37. To relieve the vacuum in the chamber 12, a solenoid-operated valve 38 may be opened to admit air to the air line 36.

Two electric heating elements 39 are mounted within the upper part of the vacuum chamber 12, clear of the drum 24.

The various controls, switches and indicator lights, indicated generally at 40, for the electric integers of the apparatus, are mounted on the front panel of the cabinet 10.

In use, the door 16 is opened and clothes to be dried are loaded through the loading opening 15 and into the perforated drum 24. The door is closed, a time control is set and by means of the appropriate switch, the vacuum pump 35 is operated to evacuate the vacuum chamber 12, so that the sealing gasket 18 of the door 16 is brought firmly onto its seating about the loading opening. At the same time the motor 34 is operated to rotate the perforated drum 24, and the heating elements 39 are energised.

The evacuation of the vacuum chamber and the rotating drum containing the tumbled clothes rapidly vaporizes the moisture in the garments and the heat emitted from the electric elements compensates for loss of latent heat of vaporization. When the pre-set time cycle has been completed, the heating elements are automatically switched off, the rotation of the drum is stopped, the operation of the vacuum pump is discontinued, and the solenoid valve 38 is opened to admit atmospheric air to the vacuum chamber and drum. The door may then be opened and the dried clothes removed.

It will be found that the clothes drier is particularly economical and efficient in operation. The partial vacuum created within the vacuum chamber 12 and the contained drum 24 by the vacuum pump rapidly vaporises and withdraws moisture in the clothes, and this action is accelerated by the tumbling of the clothes in the rotating drum, while any chilling due to loss of latent heat of vaporisation is avoided by the provision of the heating element 37.

I claim:

1. A vacuum clothes dryer comprising:

(a) a vacuum chamber mounted in a main frame, said chamber being sealed and closed except at the front thereof and dome shaped at the rear end thereof;

(b) a perforated drum spaced from and rotatably mounted within said vacuum chamber, said drum having a loading opening at the front thereof, and means for supporting said drum relatively adjacent its forward and rear ends for uniformly supporting clothes or other contents admitted to the drum to be heated;

(c) a door hingedly mounted at the front of the dryer over said loading opening, said door cooperating with sealing means mounted at the front of said chamber for effecting, when closed, an air-tight seal for sealing said chamber and said drum;

(d) drive means for rotating said drum, said drive means including means for supporting said drum adjacent the rear end thereof, said drive means further including a drive motor and gear box, a driven shaft rigidly mounted on the rear end of said drum and positioned at its forward end in a mounting plate fixed to said frame, and a chain drivably interconnecting said drive motor and said driven shaft;

(e) heating means mounted in the space between said chamber and said drum for heating the contents of said drum, (f) a motor driven vacuum pump mounted on said frame exteriorly of said chamber and connected by a vacuum line to said chamber, and wherein (g) said drive motor, mounting plate, driven shaft, and chain are mounted within said dome shaped chamber, whereby said vacuum pump creates a partial vacuum within said chamber, and thus said drum, thereby vaporizing moisture in the contents in the drum and withdrawing air and water vapor from the chamber and drum.

2. The dryer of claim 1, further including an air line communicating with said vacuum line for selectively admitting air to said chamber, and valve means positioned in said air line, said valve means being actuated at the end of the drying cycle to open said air line and eliminate the partial vacuum, thus permitting said door to be opened and the dried contents removed from said drum.

3. The dryer of claim 1, further including an air line communicating with said vacuum line for selectively admitting air to said chamber, and valve means positioned in said air line, said valve means being actuated at the end of the drying cycle to open said air line and eliminate the partial vacuum, thus permitting said door to be opened and the dried contents removed from said drum.

* * * * *